US007207175B2

(12) United States Patent
Kim

(10) Patent No.: US 7,207,175 B2
(45) Date of Patent: Apr. 24, 2007

(54) HYDRAULIC CONTROL DEVICE FOR CONTROLLING A BOOM-ARM COMBINED OPERATION IN AN EXCAVATOR

(75) Inventor: Yong Chae Kim, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 11/302,704

(22) Filed: Dec. 13, 2005

(65) Prior Publication Data

US 2006/0156714 A1 Jul. 20, 2006

(30) Foreign Application Priority Data

Dec. 16, 2004 (KR) ..... 10-2004-0107405

(51) Int. Cl.
*F15B 13/04* (2006.01)

(52) U.S. Cl. ..... 60/422; 91/448

(58) Field of Classification Search ..... 60/422, 60/426; 91/446, 448, 516
See application file for complete search history.

(56) References Cited

U.S. PATENT DOCUMENTS 5,673,558 A * 10/1997 Sugiyama et al. ..... 91/448

FOREIGN PATENT DOCUMENTS

JP 01158123 A * 6/1989

* cited by examiner

*Primary Examiner*—Michael Leslie
(74) *Attorney, Agent, or Firm*—Lee, Hong, Degerman, Kang & Schmadeka

(57) ABSTRACT

A hydraulic control device for controlling a boom-arm combined operation in an excavator includes a boom low-speed control spool and an arm high-speed control spool provided on parallel lines for receiving hydraulic flow from a second hydraulic pump via the parallel lines. A boom priority valve is provided on the parallel line interconnecting the second hydraulic pump and the arm high-speed control spool for throttling the parallel line to cause the hydraulic flow of the pump to be supplied to the boom low-speed control spool prior to the arm high-speed control spool. The boom priority valve has a pressure receiving part remaining in fluid communication with a boom pilot valve through a boom priority control signal line and a variable orifice section for reducing an opening area of the parallel line in proportion to the magnitude of a boom priority control signal pressure delivered to the pressure receiving part.

4 Claims, 3 Drawing Sheets

HYDRAULIC CONTROL DEVICE FOR CONTROLLING A BOOM-ARM COMBINED OPERATION IN AN EXCAVATOR

This application claims the benefit of the Korean Patent Application No. 10-2004-0107405, filed on Dec. 16, 2004, which is hereby incorporated by reference as if fully set forth herein.

BACKGROUND OF THE INVENTION

1. Field of the Invention

The present invention is directed to a hydraulic control device for controlling a boom-arm combined operation in an excavator and more specifically to a hydraulic control device adapted for control of a boom-arm combined operation that provides improved boom operation performance when an excavator performs works such as a loading-on-truck, a ground leveling and the like through the combined operation of a boom and an arm.

2. Description of the Related Art

Hydraulic excavators are provided with front work devices including a boom, an arm and a bucket, which can be actuated independently or in combination by a hydraulic flow discharged from one or more hydraulic pump to conduct a variety of works such as a digging, a ground leveling, a loading-on-truck and the like. As used herein, the term "combined operation" refers to an operation that is performed by simultaneous actuation of two or more of a boom cylinder, an arm cylinder and a swing motor.

As is known in the art, the conventional hydraulic excavators include a hydraulic control device, one example of which is illustrated in FIG. 1. The hydraulic control device is provided with a control valve having boom high-speed and low-speed control spools 101*a*, 101*b* and arm high-speed and low-speed control spools 103*a*, 103*b* that can be shifted to cause a boom and an arm to move at a relatively low speed ("low speed") or relatively high speed ("high speed") depending on the kind of operations to be carried out. The boom high-speed control spool 101*b* and the arm low-speed control spool 103*a*, which belong to a first spool group, are in fluid communication with a first pump P1 (hereafter, referred as "first pump"), while the boom high-speed control spool 101*a* and the arm low-speed control spool 103*b*, which belong to a second spool group, are in fluid communication with a second hydraulic pump P2 (hereafter, referred as "second pump"). The hydraulic flow generated by only one of the hydraulic pumps P1, P2 is used in actuating an arm cylinder 107 or a boom cylinder 109 at the low speed. On the contrary, the hydraulic flow generated by the first pump P1 and the hydraulic flow discharged by the second pump P2 are joined together in order to actuate the arm cylinder 107 or the boom cylinder 109 at the high speed. The flowing directions of the hydraulic flow are controlled by means of the respective control spools 101*a*, 101*b*, 103*a* and 103*b*.

In the meantime, the boom is equipped at its distal end with a reinforcing structure and various kinds of attachments with a heavy coupling device, such as a bucket or the like. This increases the weight of the boom, as a result of which the load pressure exerting on the boom cylinder 109 soars up. Thus, in case of conducting the works through a combined operation of the boom and the arm, the hydraulic flow of the pumps P1, P2 is supplied for the most part to the arm cylinder 107 whose load pressure is lower than that of the boom cylinder 109, thereby disturbing the operation of the boom and hence making it difficult to perform the combined operation in a desired manner.

Particularly, in the event that the boom and the arm are fully extended to carry out a ground leveling work, the load pressure of the boom cylinder 109 is increased to a great extent and the hydraulic flow of the pumps P1, P2 is first fed to the arm cylinder 107 to which a relatively low load pressure is exerted, which means that the boom cylinder 109 is not supplied with a sufficient amount of the hydraulic flow. This may cause the arm to abruptly descend and strike the ground, thus hindering the excavator from smoothly performing the ground leveling.

In an effort to overcome such drawbacks, the hydraulic control device shown in FIG. 1 further includes a boom priority valve 110 disposed on a parallel line 105 that interconnects the second pump P2 and the arm low-speed control spool 103*b* lying downstream of the boom high-speed control spool 101*a*. The boom priority valve 110 serves to, in case of boom-arm combined operation, throttle or disconnect the parallel line 105 so that the hydraulic flow of the second pump P2 can be supplied to the boom high-speed control spool 101*a* in the first place to thereby move the boom faster than the arm.

As can be seen in FIG. 1, the boom priority valve 110 is a solenoid-operated valve having an invariable orifice 111 of fixed-opening area and position-controlled by turning on or off a switch 112. With this boom priority valve 110, if an operator wishes to have the boom move faster or slower than the arm, the switch 112 must be manually activated in correspondence to a desired operation mode, which makes the operator feel cumbersome.

Furthermore, when shifted to a position of the invariable orifice 111, the boom priority valve 110 throttles the parallel line 105 with a constant opening area, in which condition the operating speed of the arm fluctuates in response to variation of the load pressure imparted to the boom cylinder 109. This poses a problem in that the bucket carried at a distal end of the arm does not move in a horizontal direction but hits vertically onto the ground particularly at beginning of the ground leveling work.

Another example of the hydraulic control device for controlling a boom-arm combined operation in an excavator is disclosed in Japanese Laid-open Patent Publication No. 2000-96629. This hydraulic control device is designed to supplementally supply the hydraulic flow of a second pump with the hydraulic flow of a first hydraulic pump in proportion to the differential between an arm control pilot pressure and a boom control pilot pressure, in case that an excavator performs the combined work through a boom-arm combined operation. According to the hydraulic control device disclosed in the '629 publication, there may occur such an instance that the boom-arm combined operation is not conducted smoothly, because the operating speed of a boom varies with the working load applied to an arm.

SUMMARY OF THE INVENTION

In view of the afore-mentioned problems inherent in the prior art hydraulic control devices, it is an object of the present invention to provide a hydraulic control device for controlling a boom-arm combined operation in an excavator whereby, in case of conducting a work through a boom-arm combined operation, the operating speed of a boom can be automatically controlled depending on the features of tasks in correspondence to the amount of manipulation of a boom control lever but regardless of an arm operating load.

Another object of the present invention is to provide a hydraulic control device for controlling a boom-arm combined operation in an excavator that, in case of conducting works through a boom-arm combined operation, allows an operator to change the operating speed of a boom only through the manipulation of a boom control lever without manipulations of other devices.

With this object in view, the present invention provides a hydraulic control device for controlling a boom-arm combined operation in an excavator, comprising: a first hydraulic pump and a second pump; a boom high-speed control spool and an arm low-speed control spool provided on parallel lines in tandem for receiving hydraulic flow from the first hydraulic pump via parallel lines; a boom low-speed control spool and an arm high-speed control spool provided on parallel lines in tandem for receiving hydraulic flow from the second pump via parallel lines; and a boom priority valve provided on the parallel line interconnecting the second pump and the arm high-speed control spool for throttling the parallel line to cause the hydraulic flow of the second pump to be supplied to the boom low-speed control spool prior to the arm high-speed control spool, wherein the boom priority valve has a pressure receiving part remaining in fluid communication with a boom pilot valve through a boom priority control signal line bifurcated from a boom-raising pilot line and a variable orifice section for reducing an opening area of the parallel line in proportion to the magnitude of a boom priority control signal pressure delivered to the pressure receiving part by way of the boom priority control signal line.

In a preferred embodiment of the present invention, it is desirable that the boom priority valve further has a bleed-off section formed in succession to the variable orifice section for keeping the opening area of the parallel line constant if a boom priority control signal pressure is higher than a predetermined pressure.

In a preferred embodiment of the present invention, it is also desirable that the hydraulic control device further comprise a selection switch and a selector valve provided on the boom priority control signal line for selectively opening or closing the boom priority control signal line by switching on/off the selection switch.

According to the present invention summarized above, the operating speed of a boom can be automatically controlled in correspondence to the shifting distance of a boom control lever associated with a boom pilot valve, thus facilitating a loading-on-truck and a ground leveling regardless of an arm operating load. Furthermore, the present invention enables an excavator to perform the loading-on-truck and the ground leveling by actuating a boom in the first place through the manipulation of a boom control lever without having to make other separate manipulations.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

A preferred embodiment of a hydraulic control device for controlling a boom-arm combined operation in an excavator according to the present invention will now be described in detail with reference to the accompanying drawings.

Figure 1:
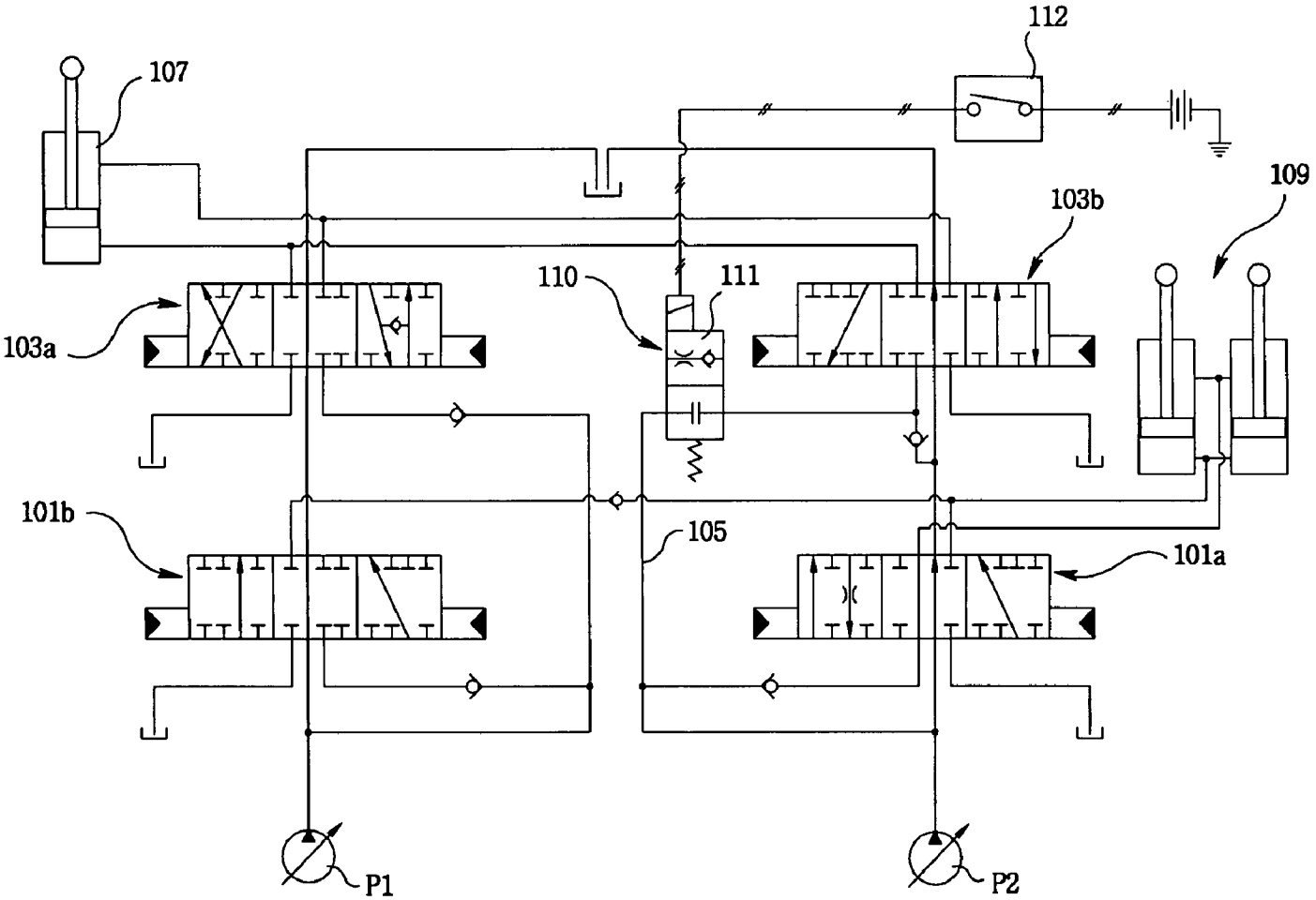
FIG. 1 (PRIOR ART)
FIG. 1 schematically shows a fluid pressure circuit employed in a prior art hydraulic control device for conducting a boom-arm combined operation in an excavator.
Figure 2:
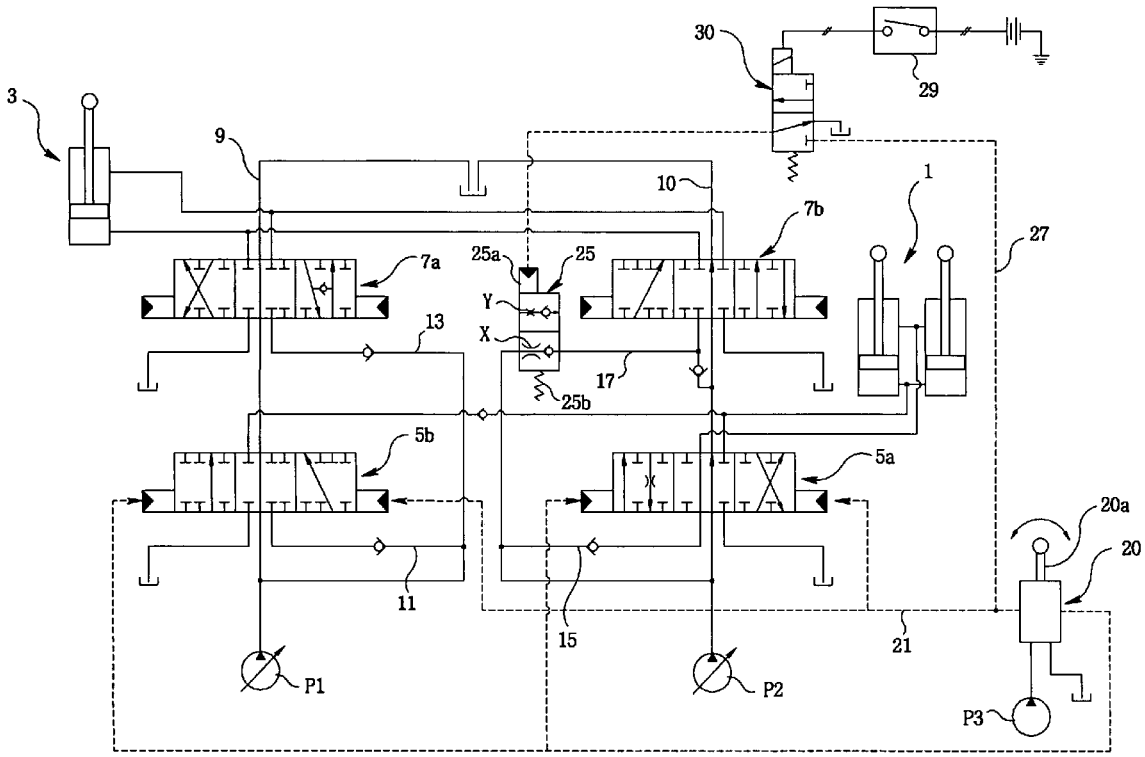
FIG. 2 is a schematic diagram showing a fluid pressure circuit employed in a hydraulic control device of the present invention for conducting a boom-arm combined operation in an excavator.

FIG. 2 is a schematic diagram showing one embodiment of a hydraulic control device of the present invention. As shown in FIG. 2, the hydraulic control device of the present invention is provided with a first hydraulic pump P1 (hereafter, referred as "first pump") and a second hydraulic pump P2 (hereafter, referred as "second pump"). The hydraulic control device is further provided with a control valve that includes a boom high-speed control spool 5*b*, an arm low-speed control spool 7*a*, a boom low-speed control spool 5*a* and an arm high-speed control spool 7*b*, each of which serves to control the actuation of a boom cylinder 1 and an arm cylinder 3 by supplying the hydraulic flow generated in the first and second pumps P1, P2 to the boom cylinder 1 and the arm cylinder 3 in a controlled manner.

The boom high-speed control spool 5*b* and the arm low-speed control spool 7*a* are respectively provided on a first bypass line 9 in tandem and in fluid communication with the first pump P1 through the parallel lines 11, 13 for receiving the hydraulic flow from the first pump P1. Normally, i.e., when in a neutral position, the boom high-speed control spool 5*b* and the arm low-speed control spool 7*a* keep the bypass line 9 opened and permit the hydraulic flow from the first pump P1 to be drained to a fluid tank. And, the parallel lines 11, 13 are maintained blocked off by the boom high-speed control spool 5*b* and the arm low-speed control spool 7*a*.

The boom low-speed control spool 5*a* and the arm high-speed control spool 7*b* are respectively provided on a second bypass line 10 in tandem and in fluid communication with second pump P2 through parallel lines 15, 17 for receiving the hydraulic flow from the second pump P2. Normally, i.e., when in a neutral position, the boom low-speed control spool 5*a* and the arm high-speed control spool 7*b* keep the bypass line 10 opened and permit the hydraulic flow from the second pump P2 to be drained to the fluid tank. And, the parallel lines 15, 17 are maintained blocked off by the boom low-speed control spool 5*a* and the arm high-speed control spool 7*b*.

A boom pilot valve 20 is in fluid communication with a pilot pump P3 and controlled by a control lever 20*a*. Depending on the shifting distance of the control lever 20*a*, the boom pilot valve 20 generates a boom high-speed control signal and a boom low-speed control signal in the form of a fluid pressure. More specifically, the boom pilot valve 20 generates the boom low-speed control signal (low pressure) if the shifting distance of the control lever 20*a* is not greater than a predetermined value, while the boom pilot valve 20 creates the boom high-speed control signal of increasing pressure according to increasing the shifting distance of the control lever 20*a*.

The boom low-speed control signal outputted from the boom pilot valve 20 acts on the boom low-speed control spool 5*a* through a boom-raising pilot line 21 to shift it into a boom raising position. Thus, the hydraulic flow of the second pump, P2 alone is supplied to the boom cylinder 1, thereby operating the boom cylinder 1 at a low speed. On the contrary, the boom high-speed control signal outputted from the boom pilot valve 20 applies on the boom high-speed control spool 5*b,* as well as the boom low-speed control spool 5*a,* through the boom-raising pilot line 21 to shift the boom high-speed control spool 5*b* into a boom raising position. In this case, the hydraulic flow of the first pump P1 is supplied to the boom cylinder 1 together with the hydraulic flow of the second pump P2 passing through the boom low-speed control spool 5*a,* thereby operating the boom cylinder 1 at a high speed.

In the meantime, on the parallel line 17 interconnecting the second pump P2 and the arm high-speed control spool 7*b,* is provided a boom priority valve 25 for throttling the parallel line 17 in proportion to the magnitude of a boom priority control signal pressure so that the hydraulic flow of the second pump P2 can be supplied to the boom low-speed control spool 5*a* prior to the arm high-speed control spool 7*b.*

Figure 3:
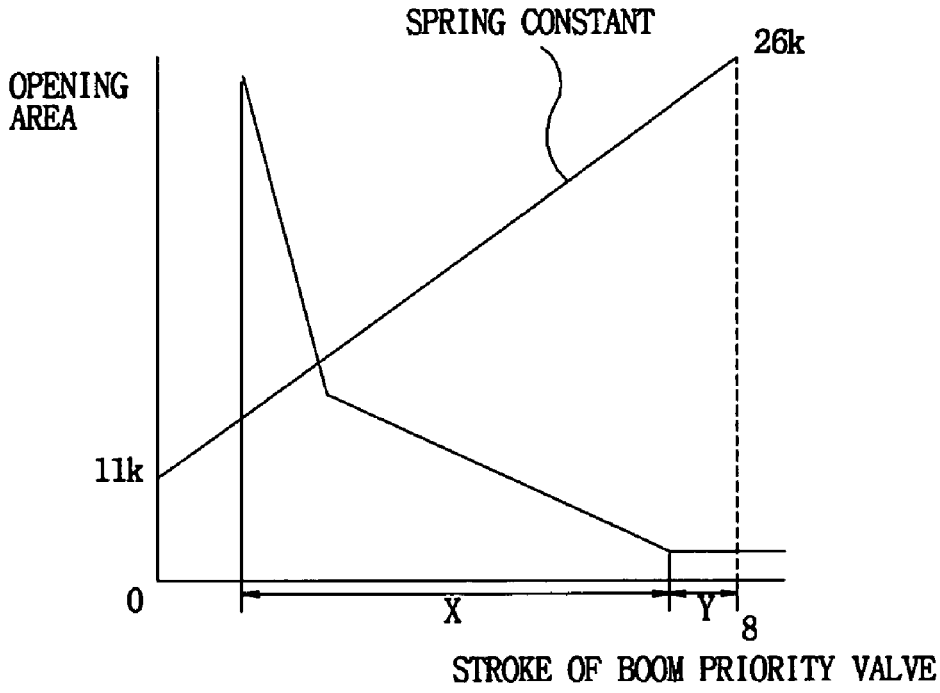
FIG. 3 is a graphical representation illustrating the correlation of a stroke and an opening area of a boom priority valve incorporated in the hydraulic control device of the present invention.

The boom priority valve 25 has a pressure receiving part 25*a* remaining in fluid communication with the boom pilot valve 20 through a boom priority control signal line 27 bifurcated from the boom-raising pilot line 21. Furthermore, the boom priority valve 25 has a variable orifice section (X) for reducing an opening area of the parallel line 17 in proportion to the magnitude of the boom priority control signal pressure delivered to the pressure receiving part 25*a* through the boom priority control signal line 27, as illustrated in FIG. 3. Additionally, the boom priority valve 25 has a bleed-off section (Y) formed in succession to the variable orifice section (X) for minimizing and keeping the opening area of the parallel line 17 constant if the boom priority control signal pressure is higher than a predetermined value, as shown in FIG. 3.

It should be appreciated that the boom priority valve 25 is normally biased by a spring 25*b* in such a manner that a specific part of the variable orifice section (X) is in alignment with the boom priority control signal line 27. If the boom priority control signal pressure is delivered to the pressure receiving part 25*a* through the boom priority control signal line 27, the boom priority valve 25 is displaced against the biasing force of the spring 25*b* in such a manner that the bleed-off section (Y) comes into alignment with the boom priority control signal line 27. The spring 25*b* for resiliently biasing the boom priority valve 25 in this manner has a spring constant as shown in FIG. 3. As can be seen in FIG. 3, in the variable orifice section (X), the opening area of the parallel line 17 is sharply reduced at an initial stage and then smoothly decreased as the stroke of the boom priority valve 25 becomes greater. However, in the bleed-off section (Y), the opening area of the parallel line 17 is minimized and then kept constant regardless of the stroke of the boom priority valve 25.

In operation, if an operator pulls slightly the control lever 20*a* of the boom pilot valve 20 to operate the boom at a low speed in a boom-arm combined operation, the boom low-speed control signal corresponding to the shifting distance of the control lever 20*a* is applied to the pressure receiving part 25*a* of the boom priority valve 25, in response to which the boom priority valve 25 variably throttles the parallel line 17 somewhere in the variable orifice section (X), as illustrated in FIG. 2. This makes greater the hydraulic flow supplied from the second pump P2 to the boom cylinder 1 through the boom low-speed control spool 5*a* than the hydraulic flow fed to the arm cylinder 3 through the arm high-speed control spool 7*b,* thus assuring that the boom is operated faster than the arm.

Under this condition, if the operator pulls the control lever 20*a* of the boom pilot valve 20 to the maximum stroke to operate the boom at a high speed, the boom priority valve 25 is shifted to the bleed-off section (Y) by the boom high-speed control signal applied to the pressure receiving part 25*a,* whereby the opening area of the parallel line 17 is minimized and then kept constant. This allows the hydraulic flow of the second pump P2 to be supplied to the boom cylinder 1 through the boom low-speed control spool 5*a* under a constant pressure, thereby increasing speed of the boom operation and preventing a bucket carried by the arm from colliding with the ground.

Optionally and additionally, a selector valve 30 is provided on the boom priority control signal line 27 for selectively opening or closing the boom priority control signal line 27 by switching on/off a selection switch 29 associated therewith. In case that there exists a need to operate the boom prior to the arm in the boom-arm combined operation, for example, in the case that the boom must be operated faster than the arm to perform a loading-on-truck or a ground leveling, the function of the boom priority valve 25 is kept alive by activating the selection switch 29 to cause the selector valve 30 to open the boom priority control signal line 27. In other cases, for example, in an usual digging during which the hydraulic flow is distributed to the boom cylinder 1 and the arm cylinder 3 depending on the load pressure of the boom, the function of the boom priority valve 25 is kept dead by deactivating the selection switch 29 to cause the selector valve 30 to shut off the boom priority control signal line 27.

As described in the foregoing, according to the hydraulic control device of the present invention, a boom priority valve automatically increases or decreases the operating speed of a boom in correspondence to the magnitude of a boom pilot signal generated by a boom pilot valve, i.e., the shifting distance of a pilot valve control lever. This makes it possible to control a boom-arm combined operation with ease and helps to improve the performance of combined operations in an excavator, such as a loading-on-truck and a ground leveling.

Although a preferred embodiment of the present invention has been described herein above, it will be apparent to those skilled in the art that various changes or modifications may be made thereto within the scope of the invention defined by the appended claims.

What is claimed is:

1. A hydraulic control device for controlling a boom-arm combined operation in an excavator, comprising:

a first hydraulic pump (P1) and a second hydraulic pump (P2);

a boom high-speed control spool (5*b*) and an arm low-speed control spool (7*a*) provided on parallel lines (11, 13) in tandem from upstream to downstream for receiving hydraulic flow from the first hydraulic pump (P1) via the parallel lines (11, 13);

a boom low-speed control spool (5*a*) and an arm high-speed control spool (7*b*) provided on parallel lines (15, 17) in tandem from upstream to downstream for receiving hydraulic flow from the second hydraulic pump (P2) via the parallel lines (15, 17); and a boom priority valve (25) provided on the parallel line (17) interconnecting the second pump (P2) and the arm high-speed control spool (7*b*) for throttling the parallel line (17) to cause the hydraulic flow of the second hydraulic pump (P2) to be supplied to the boom low-speed control spool (5*a*) prior to the arm high-speed control spool (7*b*), wherein the boom priority valve (25) has a pressure receiving part (25*a*) remaining in fluid communication with a boom pilot valve (20) through a boom priority control signal line (27) bifurcated from a boom-raising pilot line (21) and a variable orifice section (X) for reducing an opening area of the parallel line (17) in proportion to the magnitude of a boom priority control signal pressure delivered to the pressure receiving part (25*a*) by way of the boom priority control signal line (27).

2. The hydraulic control device as recited in claim 1, wherein the boom priority valve (25) further has a bleed-off section (Y) formed in succession to the variable orifice section (X) for keeping the opening area of the parallel line (17) constant if the boom priority control signal pressure is higher than a predetermined pressure.

3. The hydraulic control device as recited in claim 1, further comprising a selection switch (29) and a selector valve (30) provided on the boom priority control signal line (27) for selectively opening or closing the boom priority control signal line (27) by switching on/off the selection switch (29).

4. The hydraulic control device as recited in claim 2, further comprising a selection switch (29) and a selector valve (30) provided on the boom priority control signal line (27) for selectively opening or closing the boom priority control signal line (27) by switching on/off the selection switch (29).

* * * * *